US007651413B1

(12) United States Patent
Chen

(10) Patent No.: US 7,651,413 B1
(45) Date of Patent: Jan. 26, 2010

(54) GOLF CLUB HEAD OF HETEROGENEOUS METALS

(75) Inventor: Yung Hsiung Chen, Apia (WS)

(73) Assignee: Well Jet International Co., Ltd., Apia (WS)

( * ) Notice: Subject to any disclaimer, the term of this patent is extended or adjusted under 35 U.S.C. 154(b) by 0 days.

(21) Appl. No.: 12/169,650

(22) Filed: Jul. 9, 2008

(51) Int. Cl.
*A63B 53/04* (2006.01)

(52) U.S. Cl. ..... 473/342; 473/349; 473/350

(58) Field of Classification Search ..... 473/324–350, 473/287–292
See application file for complete search history.

(56) References Cited

U.S. PATENT DOCUMENTS 4,573,685 A * 3/1986 Young et al. ..... 473/250
4,884,808 A * 12/1989 Retzer ..... 473/288
5,221,087 A * 6/1993 Fenton et al. ..... 473/342
5,509,660 A * 4/1996 Elmer ..... 473/288
6,050,904 A * 4/2000 Kuo ..... 473/342
7,121,958 B2 * 10/2006 Cheng et al. ..... 473/345
7,374,499 B2 * 5/2008 Jones et al. ..... 473/340
7,416,494 B2 * 8/2008 Edel ..... 473/288
2003/0054901 A1 * 3/2003 Sun ..... 473/342
2006/0030424 A1 * 2/2006 Su ..... 473/342

* cited by examiner

*Primary Examiner*—Sebastiano Passaniti
(74) *Attorney, Agent, or Firm*—Leong C. Lei

(57) ABSTRACT

The present invention provides a golf club head of heterogeneous metals, which includes a main body having a front side forming a fitting cavity to which a striking face plate made of a metal having a specific weight less than nine is fit and a bottom side which is enclosed by a sole member made of a metal having a specific weight great than twelve to thereby lower the gravity center of the club head to ensure stability of ball striking and also reduce the area on which welding operation is carried out so as to effectively reduce the manufacturing costs.

1 Claim, 5 Drawing Sheets

GOLF CLUB HEAD OF HETEROGENEOUS METALS

BACKGROUND OF THE INVENTION (a) Technical Field of the Invention

The present invention relates to a golf club head of heterogeneous metals, and in particular to a golf club head that comprises a striking face plate and a sole member made of metals of different specific weights to lower down the gravity center of the club head to thereby enhance the stability of ball striking and also reducing the working hours for performing welding after assembling of component to lower down the manufacturing costs.

(b) Description of the Prior Art

Golf is a sport game with a function of social intercourse among people. Thus, the game is very popular. A regular metal golf club head is made by first shaping a main body, followed by welding a striking face plate to an opening formed in a front side of the main body. To lower down a gravity center of the club head, it is often to threadingly attach a bolt to a sole of the club head, which shifts the overall gravity center of the club head downward for enhancing stability of ball striking. However, in the conventional manner of adjusting the gravity center by threadingly attaching a bolt, the bolt that is threadingly attached to the sole of the club head may get loosened due to the striking force acting on the club head in striking golf balls. Thus, it requires constant inspection to ensure proper attachment of the bolt. Further, in the respect of welding a striking face plate to an opening in the front side of the main body, since the opening is of a substantial size, so that the area on which the welding operation is carried out is large, leading to extension of the time period for making the welding and thus increase of manufacturing costs. Further, due to the large welding area, working flaw may easily occur if the operation is not carried by an experienced welding operator. These need to be further improved.

SUMMARY OF THE INVENTION

The primary purpose of the present invention is to provide a golf club head made of heterogeneous metals, and specifically, a golf club head having a striking face plate and a sole member made of metals of different specific weighs so that the gravity center of the club head is shifted downward to enhance stability of ball striking.

Another objective of the present invention is to provide a golf club head made of heterogeneous metals, and specifically, a golf club head having a striking face plate and a sole member made of metals of different specific weights and the striking face plate is mounted to a front side of a main body in a fitting manner with the sole member enclosing a bottom of the main body so as to reduce the area on which welding operation is performed, leading to shortening of working hours and lowering of manufacturing costs.

The golf club head of heterogeneous metal in accordance with the present invention comprises a main body having a front side forming a fitting cavity to which a striking face plate made of a metal having a specific weight less than nine is fit and a bottom side which is enclosed by a sole member made of a metal having a specific weight great than twelve whereby the area on which welding operation is carried out is reduced and the working hours are shortened to thereby lower the manufacturing costs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
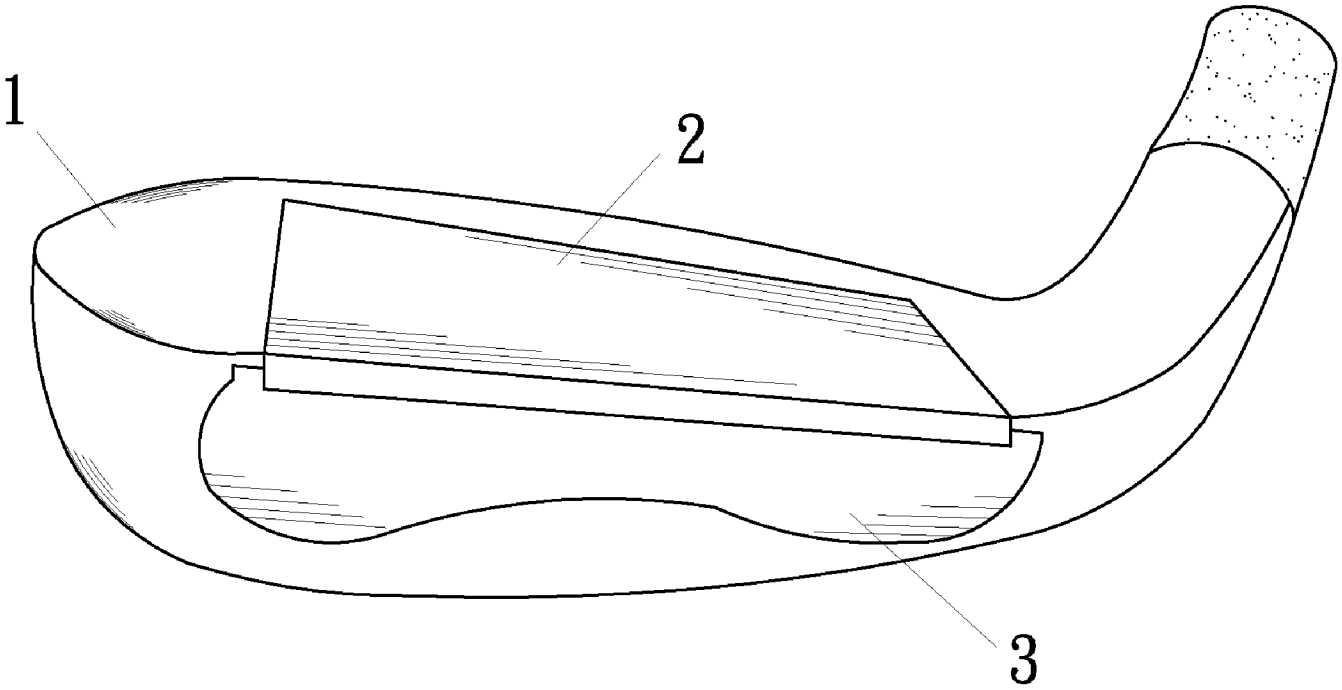
FIG. 1 is a perspective view of a golf club head in accordance with a preferred embodiment of the present invention.
Figure 2:
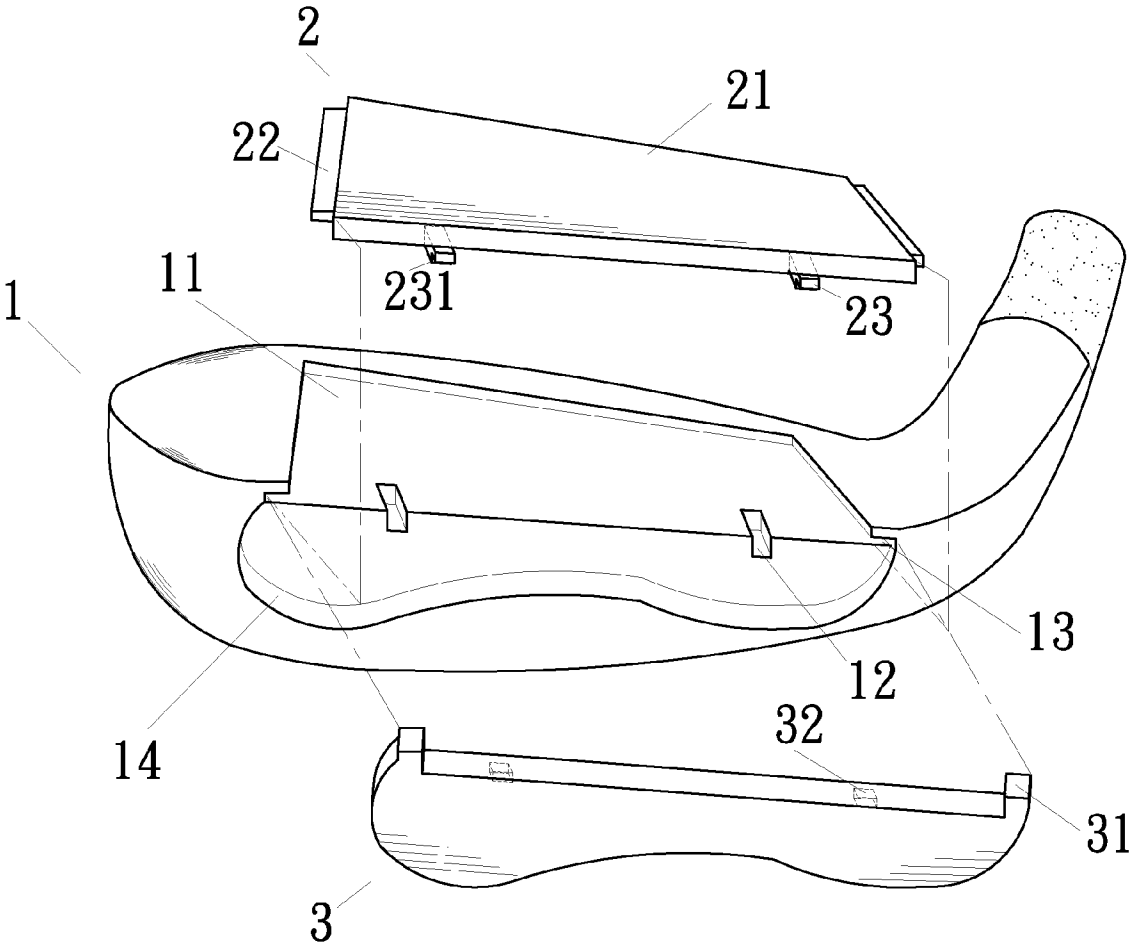
FIG. 2 is an exploded view of the golf club head in accordance with the preferred embodiment of the present invention.
Figure 3:
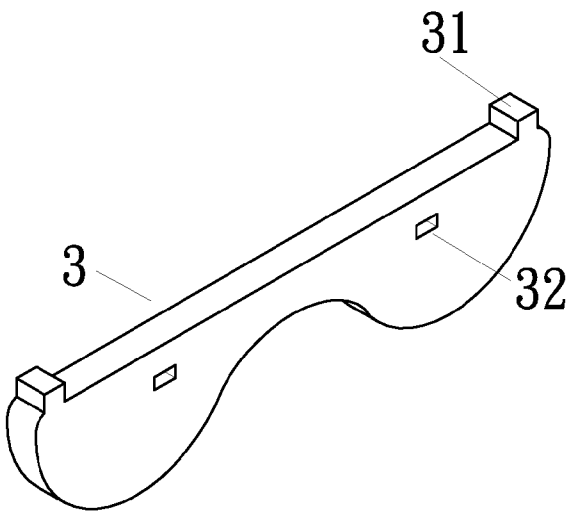
FIG. 3 is a perspective view showing a striking face plate and a sole member of the golf club head in accordance with the present invention.
Figure 3:
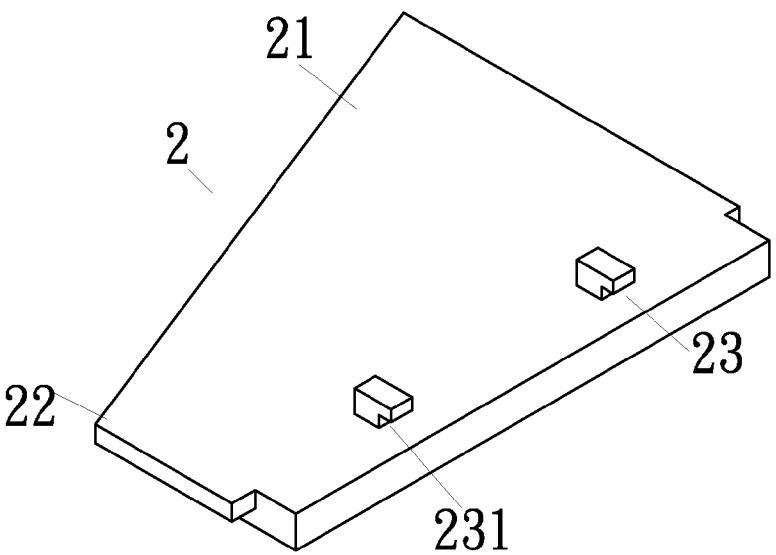

With reference to the drawings and in particular to FIGS. 1 and 2, a golf club head constructed in accordance with the present invention is comprised of a main body 1, a strike face plate 2, and a sole member 3. The main body 1 forms in a front side thereof a fitting cavity or recess 11, which is of for example a trapezoidal shape. In different applications, the fitting cavity 11 can be of a rectangular shape, a swallow-tail shape, a stepped shape, a dovetail shape, or a side-concave shape. In the fitting cavity 11, recessed retention slots 12 are defined; and also, two side walls of the fitting cavity 11 form fitting slots 13 that are recessed in an outward direction. Reference is also made to FIG. 3, the striking face plate 2 is a plate-like member having a trapezoidal shape corresponding to the fitting cavity 11. The striking face plate 2 is made of for example titanium or a metal material that has a specific weight less than nine (9). The striking face plate 2 comprises a plate body 21 having opposite edges forming fitting tabs 22 that have a length slightly less than a width of the plate body 21. Also, the plate body 21 has an underside, which forms at suitable locations on opposite edge portions thereof two retention blocks 23, each forming a notch 231. Further, the main body 1 has a bottom side that forms an enclosing cavity 14 that is formed to be continuous with the fitting cavity 11. In addition, the sole member 3 corresponds in size and shape to the enclosing cavity 14 and is made of for example chromium or nickel or a metal material that has a specific weight greater than twelve (12). The sole member 3 forms on opposite edges thereof projecting fitting blocks 31 and also, the sole member 3 forms at suitable locations two retention blocks 32 that correspond to the notches 231 of the retention blocks 23 of the striking face plate 2.

Figure 4:
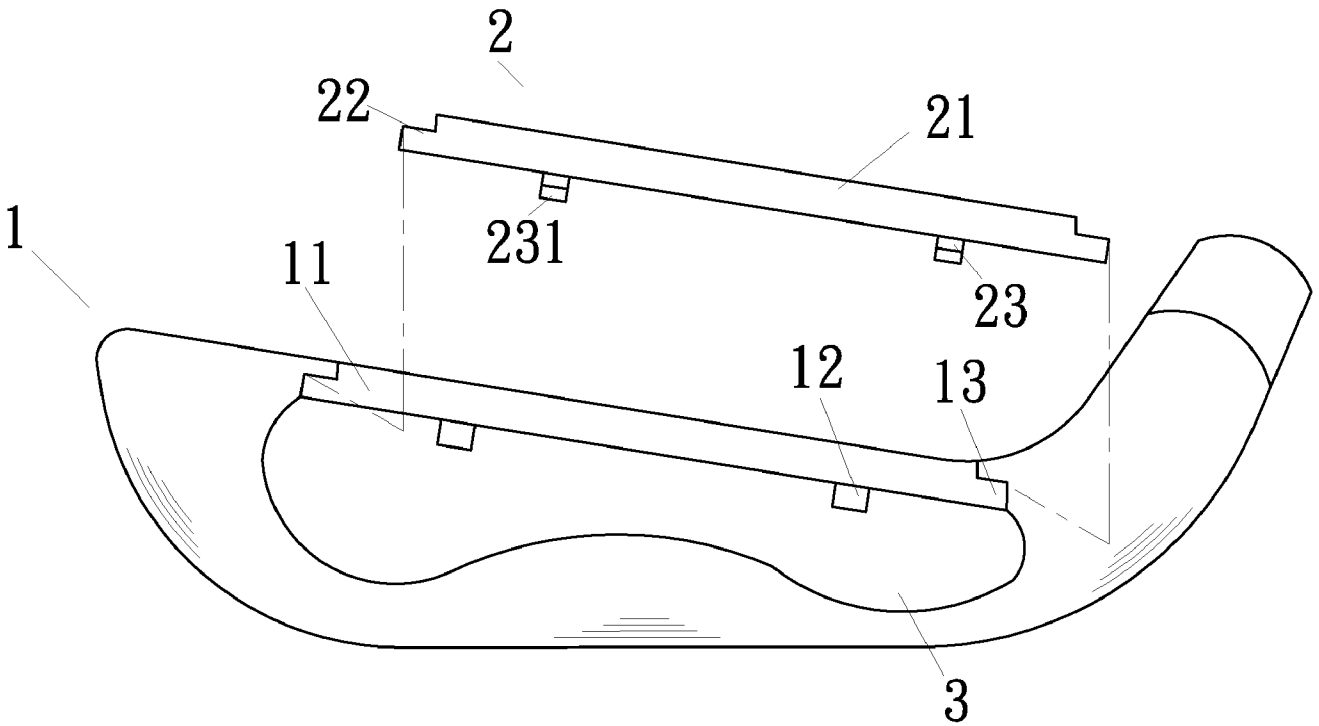
FIG. 4 demonstrates an operation of fitting the striking face plate to a main body of the golf club head of the present invention.
Figure 5:
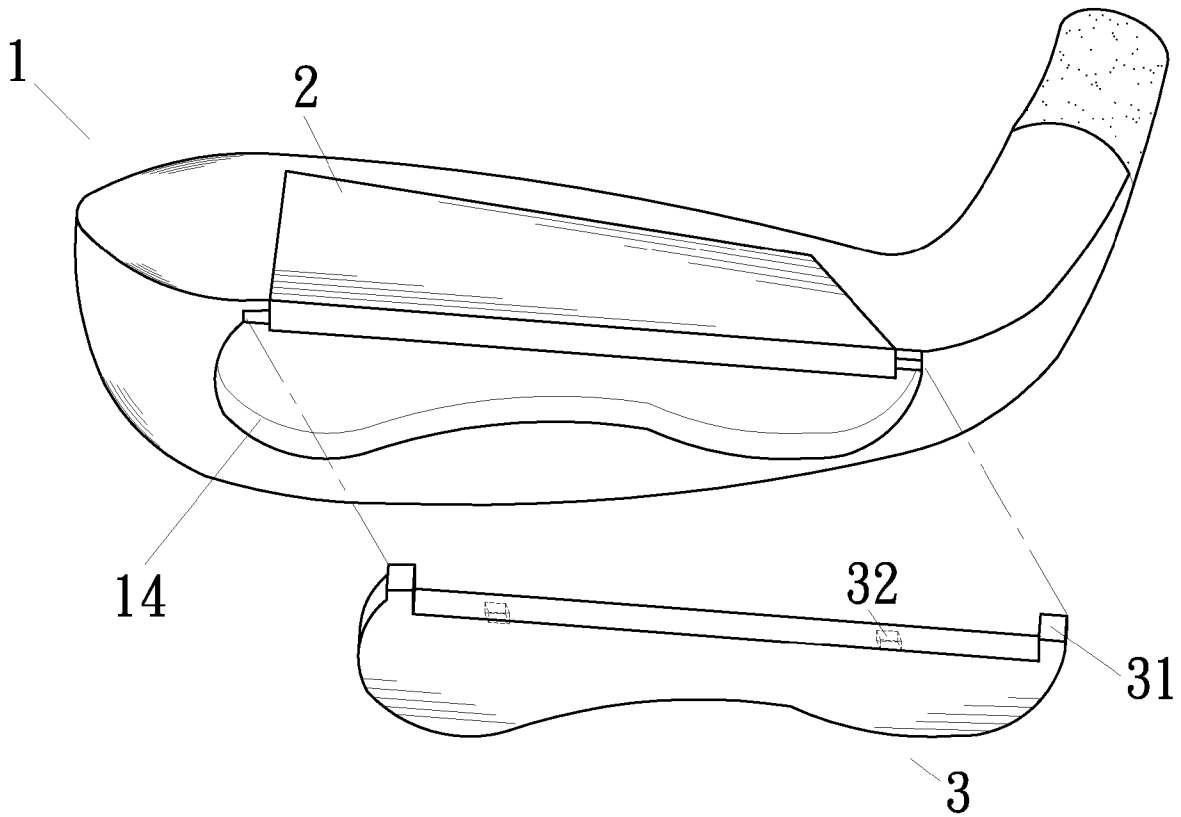
FIG. 5 demonstrates an operation of mounting the sole member to the main body of the golf club head of the present invention.

Also referring to FIG. 4, the striking face plate 2 is fit into the fitting cavity 11 of the main body 1 by having the fitting tabs 22 on opposite edges thereof fit into the fitting slots 13 on the opposite side walls of the fitting cavity 11 of the main body 1 and retained therein. Meanwhile, the retention blocks 23 of the striking face plate 2 are respectively received in the retention slots 12 of the main body 1. Also referring to FIG. 5, the sole member 3 is directly positioned in the enclosing cavity 14 of the main body 1. Since the fitting tabs 22 of the opposite edges of the striking face plate 2 are of a dimension shorter than the plate body 21, the difference in length is filled by the fitting blocks 31 on the opposite edges of the sole member 3. Also, the retention blocks 32 of the sole member 3 are filled in the notches 231 of the retention blocks 23 of the striking face plate 2 to ensure a neat engagement of the sole member 3.

Since the striking face plate 2 is made of a metal having a specific weight less than nine, while the sole member 3 is made of a metal having a specific weight greater than twelve, the striking face plate 2 is of a specific weight less than the sole member 3, and this makes the gravity center of the club head lowered, and thus enhancing stability of ball striking and improving the performance of striking. In addition, since the striking face plate 2 is mounted to the fitting cavity of the main body 1 in a fitting manner, followed by the sole member 3 positioned in the enclosing cavity 14, it only needs to carry out welding operation on the sole member 3 and the enclosing cavity 14 to complete a unitary club head. Thus, the area on which the welding operation is carried out is minimized, which leads to reduction of working hours and lowering of manufacturing costs. Further, since the working area is reduced, defect rate is reduced, also leading to lowering of manufacturing costs.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A golf club head comprising a main body, a striking face plate, and a sole member, wherein the main body forms in a front side thereof a fitting cavity, which is of a trapezoidal shape, retention slots being defined in the fitting cavity, opposite side walls of the fitting cavity forming fitting slots that are recessed in an outward direction, the striking face plate being a plate member having a trapezoidal shape corresponding to the fitting cavity and made of titanium or a metal material that has a specific weight less than nine, the striking face plate comprising a plate body having opposite edges forming fitting tabs that have a length slightly less than a width of the plate body, the plate body having an underside, which forms on opposite edge portions thereof two retention blocks, each of said retention blocks forming a notch, the main body having a bottom side that forms an enclosing cavity continuous with the fitting cavity, the sole member corresponding in size to the enclosing cavity and being made of chromium or nickel or a metal material that has a specific weight greater than twelve, the sole member forming on opposite edges thereof projecting fitting blocks, the sole member forming at suitable locations two retention blocks that correspond to the location of the notches of the retention blocks of the striking face plate body.

* * * * *